US012624906B2

(12) United States Patent
Kim et al.

(10) Patent No.: US 12,624,906 B2
(45) Date of Patent: May 12, 2026

(54) HEAT EXCHANGER

(71) Applicant: LG ELECTRONICS INC., Seoul (KR)

(72) Inventors: Jaeyoung Kim, Seoul (KR); Sukyoung Lee, Seoul (KR); Sangyeul Lee, Seoul (KR); Eungyul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 116 days.

(21) Appl. No.: 18/414,060

(22) Filed: Jan. 16, 2024

(65) Prior Publication Data

US 2024/0247881 A1 Jul. 25, 2024

(30) Foreign Application Priority Data

Jan. 19, 2023 (KR) ..... 10-2023-0008148

(51) Int. Cl.
*F28F 1/32* (2006.01)
*F24F 1/0059* (2019.01)
*F28F 1/12* (2006.01)

(52) U.S. Cl.
CPC ..... *F28F 1/325* (2013.01); *F24F 1/0059* (2013.01); *F28F 1/126* (2013.01)

(58) Field of Classification Search
CPC ..... F28F 1/32; F28F 1/12; F28F 1/325; F28F 1/126; F28F 2215/00; F28F 17/005; F24F 1/0059; F28D 1/0477; F28D 2021/0068; F28D 2021/007; F28D 1/04; F28D 2021/0071
See application file for complete search history.

(56) References Cited

FOREIGN PATENT DOCUMENTS

| | | | | |
|---|---|---|---|---|
| EP | 2 843 346 | A1 | 3/2015 | |
| JP | 10-281674 | A | 10/1998 | |
| JP | 2013-228125 | A | 11/2013 | |
| KR | 10-2020-0043897 | A | 4/2020 | |
| WO | WO-2013161290 | A1 * | 10/2013 | ..... F28D 1/0477 |
| WO | WO 2020/080862 | A1 | 4/2020 | |

* cited by examiner

*Primary Examiner* — Harry E Arant
(74) *Attorney, Agent, or Firm* — Birch, Stewart, Kolasch & Birch, LLP

(57) ABSTRACT

A heat exchanger includes: a heat transfer pipe to guide a refrigerant; and a plurality of fins spaced apart from each other to allow air to pass in a first direction, the plurality of fins each having a through-hole through which the heat transfer pipe is installed, each of the plurality of fins includes a corrugated portion formed in a zigzag shape proceeding in the first direction and a sheet portion recessed from the corrugated portion around the through-hole to be parallel with the first direction, and an area of the sheet portion corresponds to 16% or more of an area of one unit among a plurality of units of the fin.

12 Claims, 7 Drawing Sheets

HEAT EXCHANGER

CROSS-REFERENCE TO RELATED APPLICATIONS

This application claims the priority benefit of Korean Patent Application No. 10-2023-0008148 filed in the Republic of Korea on Jan. 19, 2023, which is hereby incorporated by reference in its entirety for all purposes as if fully set forth herein.

BACKGROUND OF THE INVENTION

1. Field of the Invention

The present disclosure relates to a heat exchanger with high heat exchange efficiency and low air flow resistance.

2. Description of the Related Art

In general, a heat exchanger can be used as a condenser or an evaporator in a refrigeration cycle device including a compressor, a condenser, an expansion mechanism, and an evaporator.

In addition, a heat exchanger can be installed in a vehicle, a refrigerator, and the like to exchange heat between refrigerant and air.

Heat exchangers can be classified into a finned tube type heat exchanger, a micro-channel type heat exchanger, etc.

Recently, a heat exchanger with improved performance has been introduced by employing a corrugated fin formed by bending into a corrugated shape, which enables more efficient heat exchange between refrigerant and air through the corrugated fin.

A plate fin for improving the heat transfer rate on the fin side without an increase in pressure loss on the air side is disclosed in Related Art 1, which is hereby incorporated by reference. In Related Art 1, the plate fin has a plurality of crest portions formed along a column direction, and the shape of a sheet portion around a through-hole is formed in an oval shape elongated horizontally.

In the case of Related Art 1, as the fin has the horizontally elongated shape, more air can come into contact with the periphery of a collar portion to thereby increase the heat transfer efficiency.

However, when the sheet portion is formed in the same direction as the air flow direction, air stagnation occurs.

Related Art 1—Korean Laid-Open Patent Publication No. KR2019-0115907

SUMMARY OF THE DISCLOSURE

It is an objective of the present disclosure to provide a heat exchanger that is easy to manufacture, has high heat exchange efficiency, and has low air flow resistance.

It is another objective of the present disclosure to provide a heat exchanger including a through-hole through which a heat transfer pipe passes, a corrugated portion formed in a zigzag shape proceeding in a first direction, which is an air flow direction, and a sheet portion configured as a flat surface adjacent to the through-hole, thereby facilitating the mixing of air in a region adjacent to the corrugated portion and the through-hole.

It is yet another objective of the present disclosure to provide a heat exchanger that can allow air to be uniformly mixed in a direction perpendicular to an air flow direction by designing the optimized size and width of a sheet portion and a corrugated portion.

The objectives of the present disclosure are not limited to the objectives described above, and other objectives not stated herein will be clearly understood by those skilled in the art from the following description.

According to one aspect of the subject matter described in this application, a heat exchanger includes: a heat transfer pipe to guide a refrigerant; and a plurality of fins spaced apart from each other to allow air to pass in a first direction, the plurality of fins each having a through-hole through which the heat transfer pipe is installed, wherein the plurality of fins each includes: a corrugated portion formed in a zigzag shape proceeding in the first direction, which is an air flow direction; and a sheet portion recessed from the corrugated portion around the through-hole to be parallel with the first direction, and, when dividing a fin, among the plurality of fins, into a plurality of units with respect to one sheet portion, an area of the sheet portion corresponds to 16% or more of an area of one unit.

The sheet portion may have a first length in the first direction, which is an air flow direction, and a second length in a second direction perpendicular to the air flow direction, the second length being greater than the first length.

The plurality of fins may each further include a collar in surface contact with the heat transfer pipe. The sheet portion may be connected to an outer surface of the collar.

The collar may be formed through the sheet portion and may protrude upward and downward.

The corrugated portion may be disposed between adjacent sheet portions.

The corrugated portion may include a plurality of inclined portions having an inclination with respect to the first direction.

The corrugated portion may include four inclined portions, two crest portions, and one trough portion, with respect to one sheet portion.

A center of the through-hole may be positioned to overlap the trough portion in the second direction.

The sheet portion may be formed in two inner inclined portions that are disposed between the two crest portions and define the through portion therebetween.

The four inclined portions may include outer inclined portions that define the two crest portions outside the two inner inclined portions at intermediate positions. A length of the outer inclined portion may be less than a length of the inner inclined portion.

A combined area of the two inner inclined portions may correspond to 70% or more of an area of the sheet portion.

An overlapping length between the inner inclined portion and the crest portion may be greater than or equal to 50% of the second length of the sheet portion in the second direction.

A ratio of the second length of the sheet portion to the first length of the sheet portion may be in a range of 1.2 to 1.9.

The two crest portions may be disposed so as not to overlap the sheet portion in the second direction.

The two crest portions may be positioned higher than the sheet portion in a third direction perpendicular to the first direction and the second direction.

The plurality of fins may each further include a connecting portion to connect the corrugated portion and the sheet portion.

The sheet portion may be configured such that a distance to the through-hole in the second direction is greater than a distance to the through-hole in the first direction.

According to another aspect, an air conditioner includes: an indoor heat exchanger configured to exchange heat with indoor air; and an outdoor heat exchanger configured to exchange heat with outdoor air, wherein at least one of the indoor heat exchanger and the outdoor heat exchanger includes: a heat transfer pipe to guide a refrigerant; and a plurality of fins spaced apart from each other to allow air to pass in a first direction, the plurality of fins each having a through-hole through which the heat transfer pipe vertically passes, wherein the plurality of fins each includes: a corrugated portion formed in a zigzag shape proceeding in the first direction, which is an air flow direction; and a sheet portion recessed from the corrugated portion around the through-hole to be parallel with the first direction, and wherein, when dividing a fin, among the plurality of fins, into a plurality of units with respect to one sheet portion, an area of the sheet portion corresponds to 16% or more with respect to an area of one unit, and a separation distance exists between the plurality of fins.

The corrugated portion may be disposed between adjacent sheet portions, and may include four inclined portions, two crest portions, and one trough portion in the first direction, with respect to one sheet portion.

The four inclined portions may include outer inclined portions that define the two crest portions outside two inner inclined portions at intermediate positions. A length of the outer inclined portion may be less than a length of the inner inclined portion.

A heat exchanger according to embodiments of the present disclosure has one or more of the following effects.

First, as a structure having a through-hole through which a heat transfer pipe passes, a corrugated portion formed in a zigzag shape proceeding in a first direction, which is an air flow direction, and a sheet portion configured as a flat surface adjacent to the through-hole is provided, the mixing of air in a region adjacent to the corrugated portion and the through-hole can be facilitated.

Second, as a sheet portion having a through-hole through which a heat transfer pipe passes is formed in an oval shape elongated in a direction perpendicular to an air flow direction, air passing through the sheet portion and air passing through an inclined portion can be actively or easily mixed.

Third, since the area of a sheet portion and the area of a corrugated portion are designed to have the optimized size for heat exchange, air flow disturbance is facilitated when the flow of air is generated in directions, up and down/left and right. Thus, without a louver fin, a high air flow disturbance can be caused even at low fin per inch (FPI) relative to the area ratio or width ratio, thereby increasing the heat exchange efficiency.

Fourth, as through-holes through which two rows of heat transfer pipes are coupled are arranged in a zigzag manner, the flow of air in an air flow direction is not interfered by the heat transfer pipes, allowing air to be uniformly or evenly mixed in a direction perpendicular to the air flow direction.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

The above and other objects, features and advantages of the disclosure will be more apparent from the following detailed description in conjunction with the accompanying drawings.

DETAILED DESCRIPTION OF THE EMBODIMENTS

Figure 1:
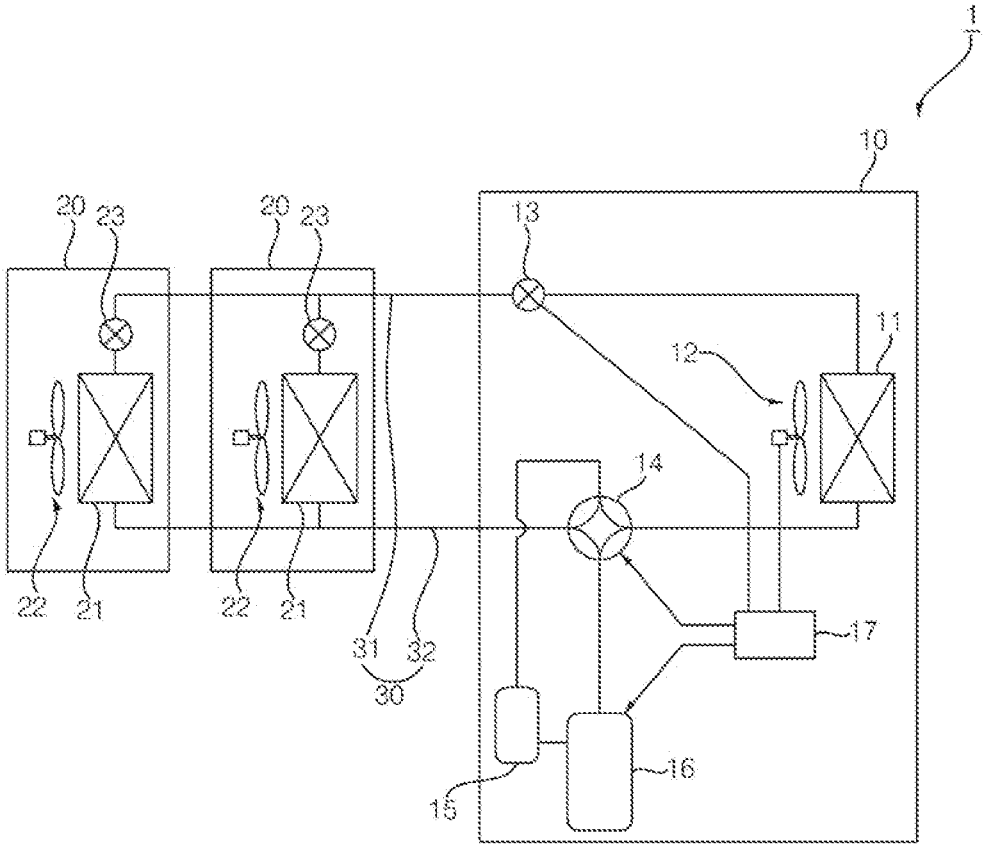
FIG. 1 is a schematic diagram of an air conditioner according to an embodiment of the disclosure.

The present invention will now be described with reference to the accompanying drawings, wherein the same reference numerals have been used to identify the same or similar elements throughout the several views.

The above and other aspects, features and other advantages of the present disclosure will be more clearly understood from the following detailed description taken in conjunction with the accompanying drawings. Exemplary embodiments will now be described more fully hereinafter with reference to the accompanying drawings; however, they may be embodied in many different forms and should not be construed as limited to the embodiments set forth herein. Rather, these embodiments are provided so that this disclosure will be thorough and complete, and will fully convey the scope of the exemplary embodiments to those skilled in the art. The same reference numerals are used throughout the drawings to designate the same or similar components.

Spatially relative terms such as "below", "beneath", "lower", "above", "upper", etc., can be used to easily describe the correlation between one component and another component as shown in the drawing. Spatially relative terms should be understood as including different directions of components at the time of use or operation in addition to the directions shown in the drawing. For example, when reversing a spherical element shown in the drawing, a component described as "below" or "beneath" of another component may be placed "above" another component. Thus, the illustrative term "below" may include both the lower and the above directions. Components can also be oriented in different directions, so that spatially relative terms can be interpreted according to the orientation.

Terms used herein are intended to describe embodiments and are not intended to limit the disclosure. In this specification, the singular form also includes the plural form unless specifically stated in the phrase. The terms "including," "comprises" and/or "comprising" as used in the specification do not exclude the presence or addition of one or more other components, steps, and/or operations to the referenced components, steps, and/or operations.

In the absence of other definitions, all terms (including technical and scientific terms) used herein may be used in a sense that can be commonly understood by persons of ordinary skill in the art to which the disclosure belongs. In addition, commonly used predefined terms are not ideally or excessively construed unless they are clearly specifically defined.

The thickness or size of each component in the drawings has been exaggerated, omitted, or schematically shown for ease of description and clarity. In addition, the size and area of each component do not fully reflect the actual size or area.

For simplicity and clarity of illustration, elements in the drawings are not necessarily drawn to scale. The same reference numbers in different drawings represent the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure. Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

In addition, the angles and directions mentioned in the process of describing the structure of the embodiment are based on those described in the drawings. In the description of the structure constituting the embodiment in the specification, if the reference point and position relationship for the angle are not clearly stated, refer to the relevant drawings.

Hereinafter, the present disclosure will be described in detail with reference to the accompanying drawings.

FIG. 1 is a schematic diagram of an air conditioner in heating operation, according to an embodiment of the present disclosure.

As shown in FIG. 1, an air conditioner 1 includes an outdoor unit 10 provided in an outdoor space, a plurality of indoor units 20 provided in an indoor space, and a refrigerant pipe 30 through which refrigerant circulates between the outdoor unit 10 and the plurality of indoor units 20.

In this embodiment, two indoor units 20 are connected to one outdoor unit 10. However, this is merely an example and is not limited thereto. That is, one indoor unit 20 may be connected to one outdoor unit 10, or three or more indoor units 20 may be connected to one outdoor unit 10.

The outdoor unit 10 includes an outdoor heat exchanger 11 for heat exchange between outdoor air and refrigerant, an outdoor blower 12 to allow outdoor air to pass through the outdoor heat exchanger 11, a compressor 16 to compress refrigerant, and a four-way valve 14 to guide refrigerant discharged from the compressor 16 to any one of the outdoor unit 10 and the indoor unit(s) 20, an outdoor expansion valve 13 to depressurize and expand refrigerant, and an accumulator 15 to separate liquid refrigerant from refrigerant introduced into the compressor 16 so that the liquid refrigerant is vaporized and introduced into the compressor 16.

In addition, the outdoor unit 10 includes a controller 17 to control the operation of the outdoor blower 12, the outdoor expansion valve 13, the compressor 16, and the four-way valve 14. The controller 17 may be configured as a microcomputer and the like.

Each indoor unit 20 includes an indoor heat exchanger 21 for heat exchange between indoor air and refrigerant, an indoor blower 22 to allow indoor air to pass through the indoor heat exchanger 21, and an indoor expansion valve 23 to depressurize and expand refrigerant.

The refrigerant pipe 30 includes a liquid refrigerant pipe 31 through which liquid refrigerant passes, and a gas refrigerant pipe 32 through which gaseous refrigerant passes. The liquid refrigerant pipe 31 allows refrigerant to flow between the indoor expansion valve 23 and the outdoor expansion valve 13.

The gas refrigerant pipe 32 guides refrigerant to flow between the four-way valve 14 of the outdoor unit 10 and the gas side of the indoor heat exchanger 21 of the indoor unit 20.

As for the refrigerant used in the air conditioner, any one of hydrocarbon (HC) refrigerant, HC mixed refrigerant, R32, R410A, R407C, and carbon dioxide may be preferably used, however, any known type of refrigerant may be used.

Figure 2:
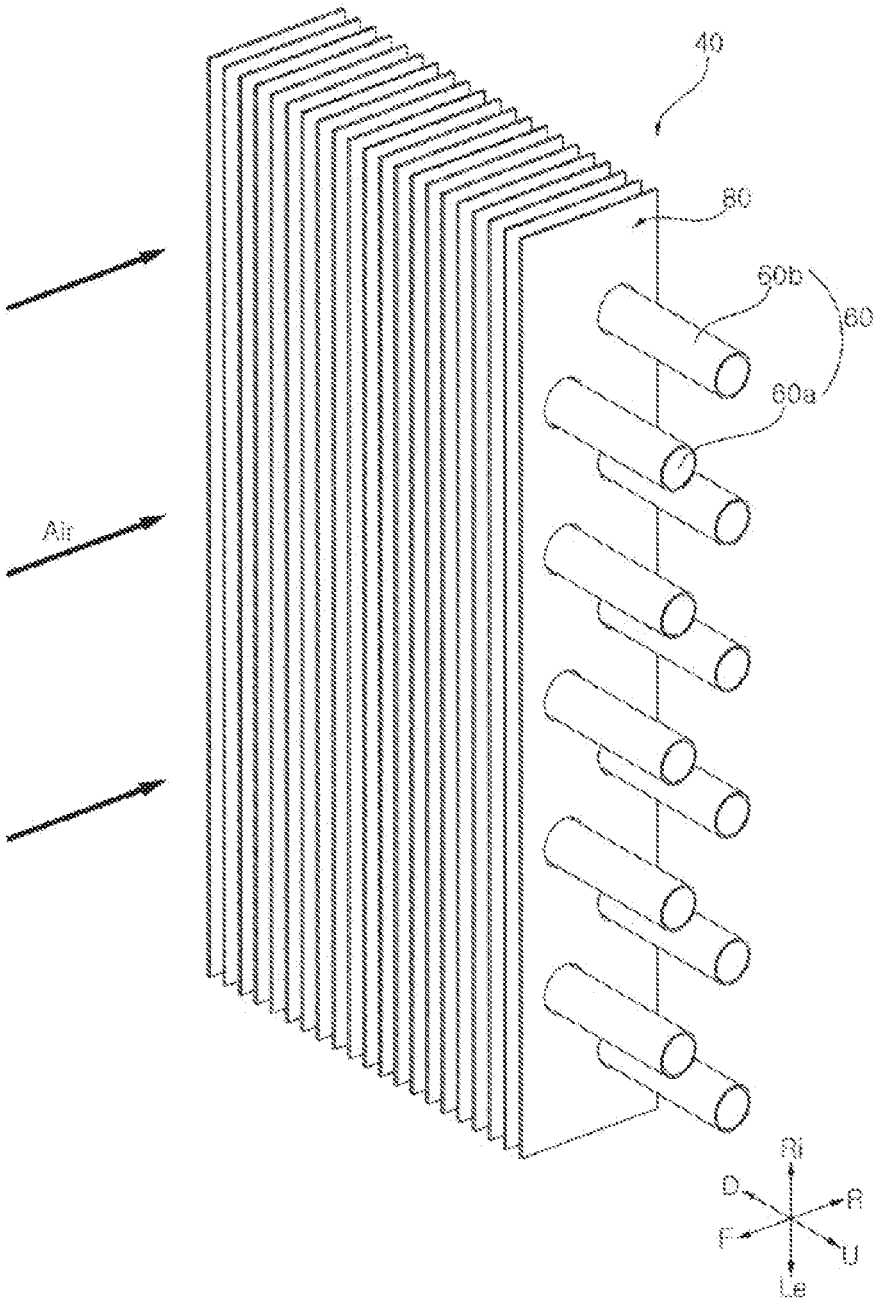
FIG. 2 is a perspective view of a heat exchanger according to an embodiment of the disclosure.
Figure 3:
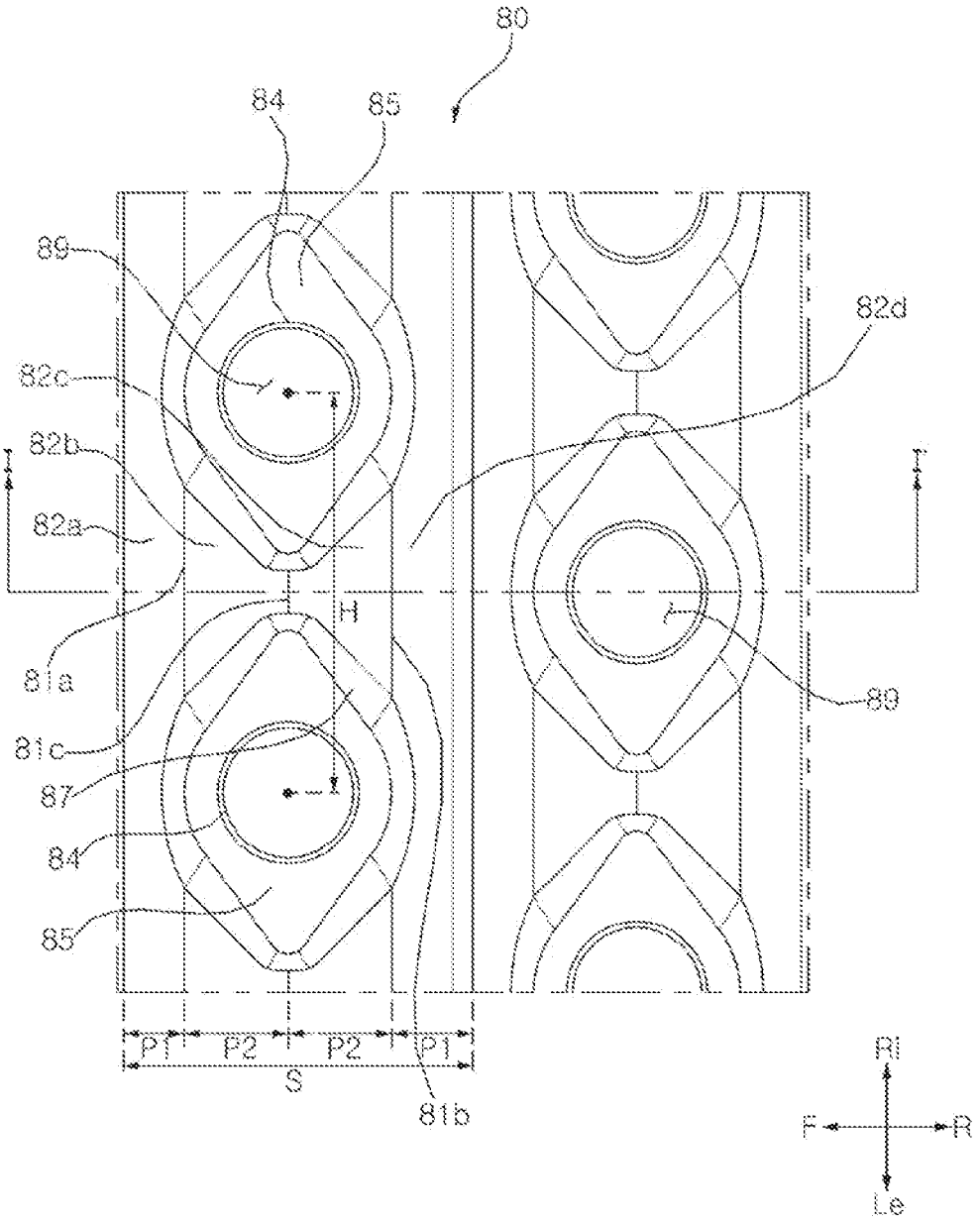
FIG. 3 is an enlarged plan view showing a portion of a fin according to an embodiment of the disclosure.

FIG. 2 is a perspective view of a heat exchanger according to an embodiment of the present disclosure, and FIG. 3 is an enlarged plan view showing a portion of a fin according to an embodiment of the disclosure.

Referring to FIGS. 2 and 3, a heat exchanger 40 corresponds to at least one of the outdoor heat exchanger 11 and the indoor heat exchanger 21 shown in FIG. 1.

The heat exchanger 40, which is a fin tube type heat exchanger, includes a plurality of fins 80 made of aluminum and a heat transfer pipe 60 of a circular cross section made of copper, aluminum or any other metal.

A plurality of heat transfer pipes 60 extend in a left-right direction (e.g., second direction) (LeRi) perpendicular to an air flow direction. In detail, the plurality of heat transfer pipes 60 may include a plurality of first-row heat transfer pipes **60*a* spaced apart from each other in an up-down direction (e.g., third direction) (UD), and a plurality of second-row heat transfer pipes 60*b* spaced rearward from the first-row heat transfer pipes 60*a*** and spaced apart from each other in the up-down direction.

A pitch between the first-row heat transfer pipes **60*a* is the same as a pitch between the second-row heat transfer pipes 60*b*, and the first-row heat transfer pipes 60*a* and the second-row heat transfer pipes 60*b* are arranged (e.g., are staggered) so as not to overlap each other in a front-rear direction (e.g., first direction) (FR). As the first-row heat transfer pipes 60*a* and the second-row heat transfer pipes 60*b* are arranged so as not to overlap each other in the front-rear direction, resistance exerted by the heat transfer pipes 60** on air flowing in the front-rear direction may be reduced.

The plurality of fins 80 are disposed perpendicular to the heat transfer pipe 60 and are spaced apart from one another, allowing air to pass between the plurality of fins 80 in the first direction (e.g., front-rear direction). The heat transfer pipes 60 are installed vertically through through-holes 89 provided in the respective plurality of fins 80, and are arranged parallel to each other. The heat transfer pipes 60 are connected to the refrigerant pipe 30 of the air conditioner of FIG. 1 to thereby constitute a refrigeration cycle of a closed circuit.

In addition, as the heat transfer pipe 60 is in contact with the fin 80 to transmit or receive heat through the fin 80, a contact area with air passing through the heat exchanger 40 through the fin 80 increases. Accordingly, heat exchange between refrigerant passing through an inside of the heat transfer pipe 60 and refrigerant passing through the heat exchanger 40 can be efficiently achieved through the fin 80.

In order for more efficient heat transfer between the fin 80 and air, using a press mold, the fin 80 is bent in a zigzag shape proceeding in the first direction (front-rear direction), which is an air flow direction, allowing the fin 80 to have a corrugated form. Hereinafter, the fin 80 having such a corrugation may also be referred to as a corrugated fin.

The fin 80 includes a collar 84 in surface contact with the heat transfer pipe 60 and a sheet portion 85 configured as a flat surface around the collar 84 to define the collar 84. As the sheet portion 85 is adjacent to the collar 84 in contact with the heat transfer pipe 60, the sheet portion 85 has a temperature similar to a temperature of refrigerant passing through the heat transfer pipe 60. The sheet portion 85 is connected to an outer surface of the collar 84.

The collar 84 protrudes from the sheet portion 85 in the up-down direction (UD), and has a cylindrical shape.

As the collar 84 has the cylindrical shape formed through the sheet portion 85, heat from the heat transfer pipe 60 may be effectively transferred to the sheet portion 85 when coupled to the heat transfer pipe 60.

Here, the collar 84 may be configured such that a height protruding in an upward direction of the sheet portion 85 and a height protruding in a downward direction of the sheet portion 85 are different, and the height protruding in the upward direction may be greater.

Accordingly, heat exchange between refrigerant and air can be efficiently achieved in the sheet portion 85, allowing more air to come into contact with the sheet portion 85. As a result, heat exchange efficiency of the heat exchanger 40 can be improved.

The heat exchanger 40 according to the embodiment of the disclosure provides a corrugated fin 80 capable of maintaining heat exchange efficiency while having relatively low fin per inch (FPI).

Thus, the number of corrugated fins 80 coupled per length of the heat transfer pipe 60 can be significantly lower, which corresponds to ½ to ⅓ of the general number.

As such, when a plurality of corrugated fins 80 constituting the heat exchanger 40 are penetrated by the same heat transfer pipe 60, a separation distance of neighboring or adjacent corrugated fins 80 may be greater than the height of the collar 84.

That is, a portion of the heat transfer pipe 60, which is not surrounded by the collar 84, is exposed to the outside to thereby require a smaller number of corrugated fins 80.

By changing the structure of the corrugated fins 80, the heat exchanger 40 may provide an optimized structure for maintaining heat exchange efficiency while having low FPI.

Figure 4:
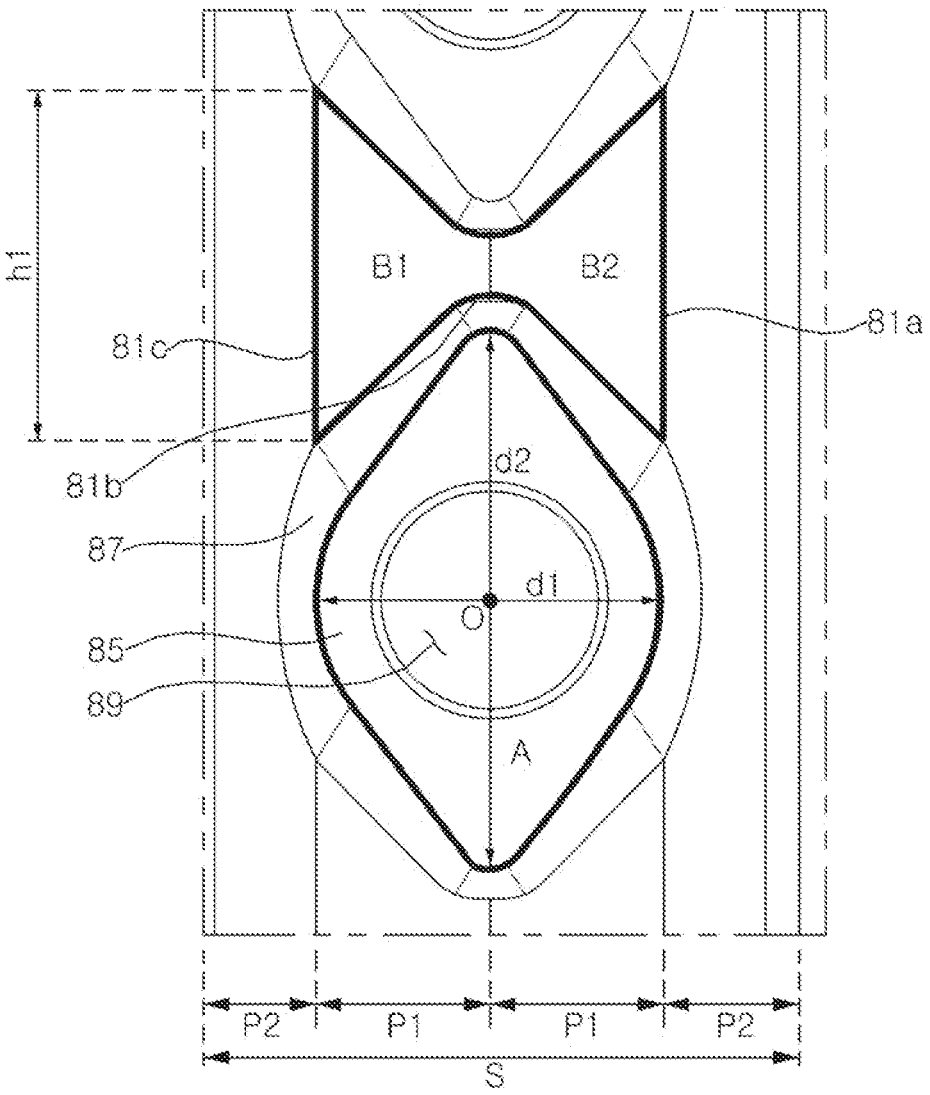
FIG. 4 is an enlarged plan view showing one unit of the fin in FIG. 3.
Figure 5:
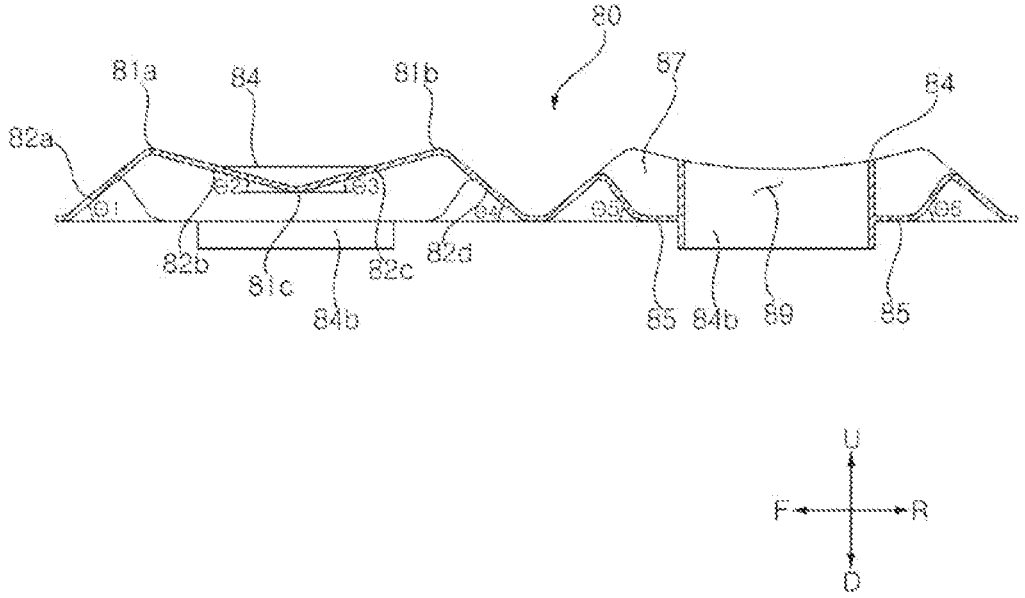
FIG. 5 is a cross-sectional view taken along line I-I' of the fin in FIG. 3.
Figure 6:
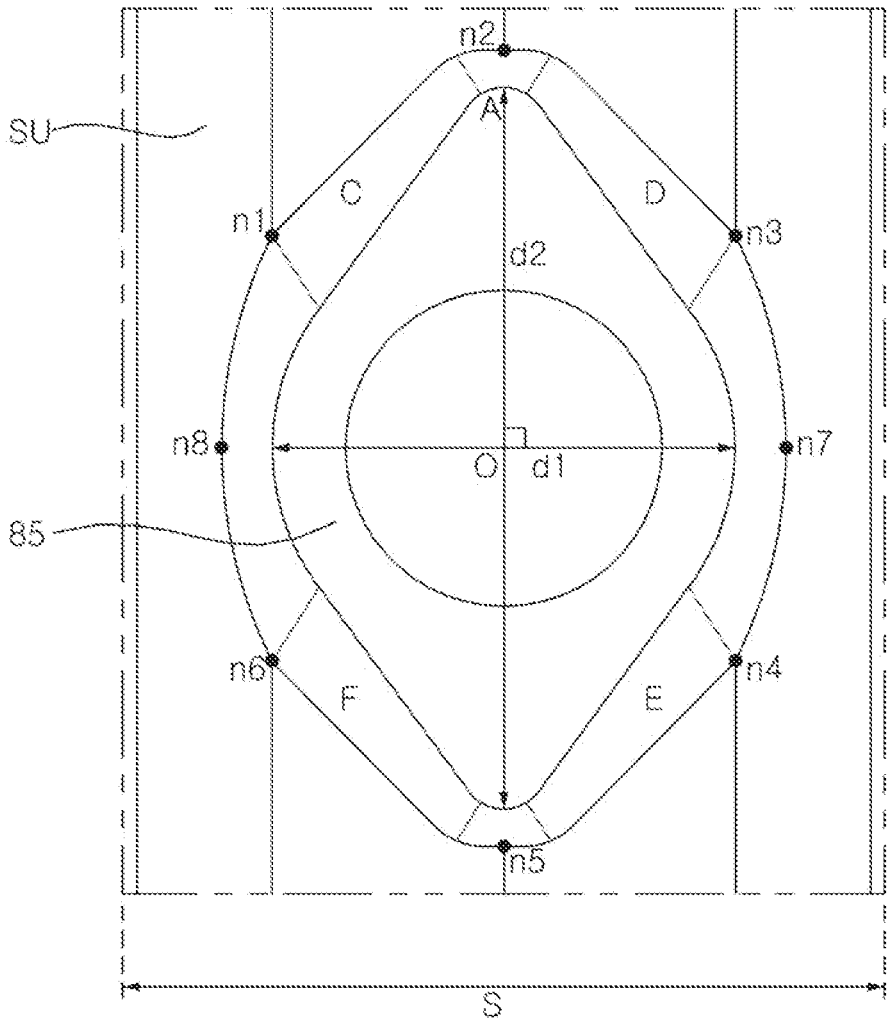
FIG. 6 is an enlarged view showing a portion of FIG. 3.

FIG. 4 is an enlarged plan view showing one unit of the fin in FIG. 3, FIG. 5 is a cross-sectional view taken along line I-I' of the fin in FIG. 3, and FIG. 6 is an enlarged view showing a portion of FIG. 3.

Referring to FIGS. 3 to 6, the sheet portion 85 may define a surface aligned with the first direction, around the through-hole 89. In detail, the sheet portion 85 may be defined as a surface aligned with the first direction (F-R direction) and the second direction (Ri-Le direction), around the through-hole 89.

The sheet portion 85 has a first length d1 in the first direction (F-R direction), which is an air flow direction, and a second length d2 in the second direction (Ri-Le direction), which is perpendicular to the first direction, to be greater than the first length d1.

That is, the sheet portion 85 may be defined to have an oval shape elongated vertically. Here, the oval shape is only defined as having the second length d2 in the second direction greater than the first length d1 in the first direction, and all of its boundary surfaces are not necessarily having curvature.

In other words, a portion of a boundary line may be configured as a straight line, which may be defined as a rhombus shape elongated in the second direction.

The shape of the sheet portion 85 is only defined as a shape elongated vertically, namely, a shape elongated in the second direction perpendicular to the air flow direction.

As the sheet portion 85 has the shape elongated vertically, more air may be exchanged and mixed around the sheet portion 85 and a corrugated portion that is disposed between two adjacent sheet portions 85, thereby improving the heat exchange efficiency of the heat exchanger 40.

That is, the corrugated fin 80 includes a corrugated portion. The corrugated portion is a region formed in a zigzag shape proceeding in the first direction, which is the air flow direction. The corrugated portion is disposed between adjacent sheet portions 85.

The corrugated portion includes four inclined portions 82*a*, 82*b*, 82*c* and 82*d*, two crest portions 81*a* and 81*b*, and one trough portion 81*c*. The two crest portions 81*a* and 81*b* and the one trough portion 81*c* are defined by the four inclined portions 82*a*, 82*b*, 82*c*, and 82*d*.

The crest portions (81*a*. 81*b*) include a first crest portion 81*a* positioned relatively forward and a second crest portion 81*b* positioned rearward relative to the first crest portion 81*a*, and the trough portion 81*c* is disposed between the first crest portion 81*a* and the second crest portion 81*b*.

The four inclined portions 82*a*, 82*b*, 82*c*, and 82*d* have an inclination with respect to the first direction (F-R direction), and extend in the second direction.

In detail, the inclined portions (82*a*, 82*b*. 82*c*, 82*d*) may include a first inclined portion 82*a* that is connected to the front of the first crest portion 81*a*, a second inclined portion 82*b* that is connected to the rear of the first crest portion 81*a* and connects the first crest portion 81*a* and the trough portion 81*c*, a third inclined portion 82*c* that is connected to the front of the second crest portion 81*b* and connects the second crest portion 81*b* and the trough portion 81*c*, and a fourth inclined portion 82*d* that is connected to the rear of the second crest portion 81*b*.

Here, the crest portions 81*a* and 81*b*, and the trough portion 81*c* are folded portions when the corrugated fin 80 is bent to form the inclined portions 82*a*, 82*b*, 82*c* and 82*d*, and the inclined portions 82*a*, 82*b*, 82*c*, and 82*d* are inclined surfaces inclined with respect to the surface of the fin 80 before the formation of the inclined portions 82*a*, 82*b*, 82*c*, and 82*d*.

Thus, the fin 80 includes the crest portions 81*a* and 81*b*, the trough portion 81*c*, and the inclined portions 82*a*, 82*b*, 82*c*, and 82*d* connected to each other in a zigzag shape by the crest portions 81*a* and 81*b* and the trough portion 81*c*. A zigzag-shaped corrugated portion is formed by the crest portions 81*a* and 81*b*, the trough portion 81*c*, and the inclined portions 82*a*, 82*b*, 82*c*, and 82*d*.

The second inclined portion 82*b* may decrease in width in the second direction from front to rear, and the third inclined portion 82*c* may increase in width in the second direction from front to rear.

Here, a length P2 of the first inclined portion 82*a* may correspond to 55% to 90% of a length P1 of the second inclined portion 82*b*, and may preferably correspond to 58% to 88% of the length P1 of the second inclined portion 82*b*.

This may be equally applied to the case of the fourth inclined portion 82*d* and the third inclined portion 82*c*.

That is, as the length P1 of a region on the inner side is secured, an area of the sheet portion 85 having the first length d1 in the first direction, which is the same direction as the sum (P1+P1) of the lengths of the second and third inclined portions 82*b* and 82*c*, may be secured, thereby improving the heat exchange efficiency.

The first crest portion 81*a*, the second crest portion 81*b*, and the trough portion 81*c* extend in the second direction. A center O of the through-hole 89 may be located to overlap the trough portion 81*c* in the second direction. The two crest portions 81*a* and 81*b* may be disposed so as not to overlap the through-hole 89 in the second direction.

The two crest portions 81*a* and 81*b* may be disposed so as not to overlap the sheet portion 85 in the second direction. The sheet portion 85 is positioned between the two crest portions 81*a* and 81*b*.

Thus, due to the interaction of the sheet portion 85 with the trough portion 81*c* and the crest portion 81*a*, 81*b*, air can be uniformly mixed in the second direction.

The two crest portions 81*a* and 81*b* are positioned higher in the third direction (U-D direction) than the sheet portion 85. Also, the trough portion 81*c* is positioned higher in the third direction than the sheet portion 85. The two crest portions 81*a* and 81*b* are positioned higher in the third direction than an upper end (or top) of the collar 84. The trough portion 81*c* is positioned lower in the third direction than the upper end of the collar 84.

A first inclination angle Θ1 of the first inclined portion 82*a* with the first direction is equal to a fourth inclination angle Θ4 of the fourth inclined portion 82*d* with the first direction. A second inclination angle Θ2 of the second inclined portion 82*b* with the first direction is equal to a third inclination angle Θ3 of the third inclined portion 82*c* with the first direction.

The first inclination angle Θ1 of the first inclined portion 82*a* with the first direction and the fourth inclination angle Θ4 of the fourth inclined portion 82*d* with the first direction may be greater than the second inclination angle Θ2 of the second inclined portion 82*b* with the first direction and the third inclination angle Θ3 of the third inclined portion 82*c* with the first direction.

The first inclination angle Θ1 of the first inclined portion 82*a* with the first direction and the fourth inclination angle Θ4 of the fourth inclined portion 82*d* with the first direction may each have a range of 30° to 45°, and the second inclination angle Θ2 of the second inclined portion 82*b* with the first direction and the third inclination angle Θ3 of the third inclined portion 82*c* with the first direction may each have a range of 7° to 20°.

The first crest portion 81*a* and the second crest portion 81*b* may preferably be front-rear symmetric with respect to the trough portion 81*c*.

Here, a width of the fin 80 (hereinafter referred to as a "fin width") is denoted as S. and an interval between the heat transfer pipes 60 is denoted as H.

As defined above, the sheet portion 85 has the first length d1, which is a longest length passing through a center O of the heat transfer pipe 60 in the first direction, namely, the air flow direction, and the second length d2, which is a longest length passing through the center O of the heat transfer pipe 60 in the second direction perpendicular to the first direction, namely, the air flow direction.

Here, the center O of the heat transfer pipe 60 is located at a position corresponding to the trough portion 81*c*.

The interval H between the heat transfer pipes 60 is defined as a distance from a center O of one heat transfer pipe 60 to a center O of another (or next) heat transfer pipe 60 in the second direction.

In this embodiment, the sheet portion 85 may have a curvature at each local extremum point of four directions which are farthest points from the center O of the heat transfer pipe 60, and a distance between the local extremum points of the four directions may be a straight line.

Here, a distance between each local extremum point and the through-hole 89 may be greater in the second direction than the first direction. That is, the area defining the sheet portion 85 is larger vertically.

A ratio of the second length d2 of the sheet portion 85 to the first length d1 of the sheet portion 85 may preferably be in a range of 1.2 to 1.9.

The corrugated fin 80 has a predetermined ratio between the area of the sheet portion 85, namely, an area A of the oval shape (which has the first length d1 and the second length d2) and an area B1, B2 of a corrugated portion on top thereof.

That is, when a region defining one sheet portion 85 is classified as one unit as shown in FIG. 4, one unit includes one sheet portion 85 and a corrugated portion disposed between adjacent sheet portions 85.

As shown in FIG. 4, a region of the corrugated portion includes triangular shapes in which portions of the second inclined portion 82*b* and the third inclined portion 82*c* are symmetrical with each other.

That is, the second inclined portion 82*b* defines a first triangle B1 and the third inclined portion 82*c* defines a second triangle B2, and the first triangle B1 and the second triangle B2 are arranged to be point symmetric with respect to a point passing through the trough portion 81*c*.

The sum of areas of the first triangle B1 and the second triangle B2 may correspond to 60 to 80% of the area A of the sheet portion 85.

More preferably, the sum (B1+B2) of the areas of the first triangle B1 and the second triangle B2 may correspond to 70% or more of the area A of the sheet portion 85.

In addition, the one unit has an optimized ratio between the second length d2 in the second direction of the sheet portion 85 and a length hl of one side of the first triangle B1 and the second triangle B2, namely, an overlapping length hl between the first triangle B1 and the first crest portion 81*a*, and between the second triangle B2 and the second crest portion 81*b*.

That is, the overlapping length hl may correspond to 50% or more of the second length d2.

As such, when the area occupied by the sheet portion 85 and the area occupied by the corrugated portion in one unit are designed to satisfy a predetermined ratio, the upward and downward movement of air may be facilitated even when the number of fins 80 is small, thereby achieving the heat exchange performance.

Also, in the present disclosure, a louver is not provided in the corrugated portion, thereby achieving high resistance to corrosion and aging, and delaying degradation.

In other words, instead of employing a louver in a corrugated portion to increase heat exchange, which is conventionally used in the case of low FPI, the function to increase heat exchange may be sufficiently achieved using the predetermined ratio of the area and overlapping length of the corrugated portion to the area and length of the sheet portion 85.

In addition, each of the corrugated fins 80 includes a connecting portion 87 to connect the corrugated portion and the sheet portion 85. The connecting portion 87 is an inclined surface that connects the sheet portion 85 and the corrugated portion, namely, the crest portions 81*a* and 81*b* and the trough portion 81*c* that define the corrugated portion. The connecting portion 87 is configured to surround the sheet portion 85.

Accordingly, condensed water generated in the heat exchanger 40 can easily flow along the trough portion 81*c* to thereby prevent the condensed water from being accumulated in the sheet portion 85. As a result, an increase in air resistance in the sheet portion 85 can be suppressed.

The connecting portion 87 may have an inclination with respect to the first and third directions. In detail, inclination angles Θ5 and Θ6 between the connecting portion 87 and the first direction may be greater than the first inclination angle Θ1 of the first inclined portion 82*a* with the first direction, the fourth inclination angle Θ4 of the fourth inclined portion 82*d* with the first direction, the second inclination angle Θ2 of the second inclined portion 82*b* with the first direction, and the third inclination angle Θ3 of the third inclined portion 82*c* with the first direction.

Centers of the trough portion 81*c* and the crest portions 81*a*, 81*b* may be disposed to overlap the center O of the heat transfer pipe 60 in the front-rear direction.

Here, the connecting portion 87 may be divided into four quadrants.

A boundary line between the connecting portion 87 and the corrugated portion includes a plurality of inflection points.

As shown in FIG. 6, on the boundary line between the connecting portion 87 and the corrugated portion, two end points having the longest width in the first direction from the center O of the heat transfer pipe 60 may be referred to as horizontal contact points n7 and n8, two end points having the longest width in the second direction from the center O of the heat transfer pipe 60 may be referred to as vertical contact points n2 and n5, and points in contact with the crest portions 81*a* and 81*b* between the horizontal and vertical contact points (n7, n8, n2, n5) may be referred to as inclined contact points n1, n3, n4, and n6.

Four contact points defining the inclined contact points n1, n3, n4, and n6 are positioned highest in the third direction.

The connecting portion 87 may include four partition surfaces C, D, E, and F formed in four quadrants defined by the first and second directions from the center O of the heat transfer pipe 60, and the partition surfaces C, D, E, and F may have the same shape.

Here, each of the partition surfaces C, D, E, and F is configured such that a distance from each of the horizontal and vertical contact points (n7, n8, n2, n5) to the sheet portion 85 is the shortest, and a distance from each of the inclined contact points (n1, n3, n4, n6) to the sheet portion 85 is the longest.

As shown in FIG. 6, when a reference region SU having one sheet portion 85 is divided based on the center O of the heat transfer pipe 60, an area S85 defining the sheet portion 85 corresponds to 10 to 30% of an entire area of one reference region SU.

More preferably, the area S85 defining the sheet portion 85 may correspond to 16 to 25% of an entire area of one reference region SU.

That is, as the area S85 defining the sheet portion 85 is increased as compared to the related art, the flow rate of air flowing through the sheet portion 85 is increased, thereby facilitating heat exchange with the heat transfer pipe 60.

When an area ratio of the sheet portion 85 becomes too large and exceeds 25%, a rapid decrease in the performance occurs. Therefore, the area ratio of the sheet portion 85 may be 25% or less of the entire area of the reference region SU.

Figure 7:
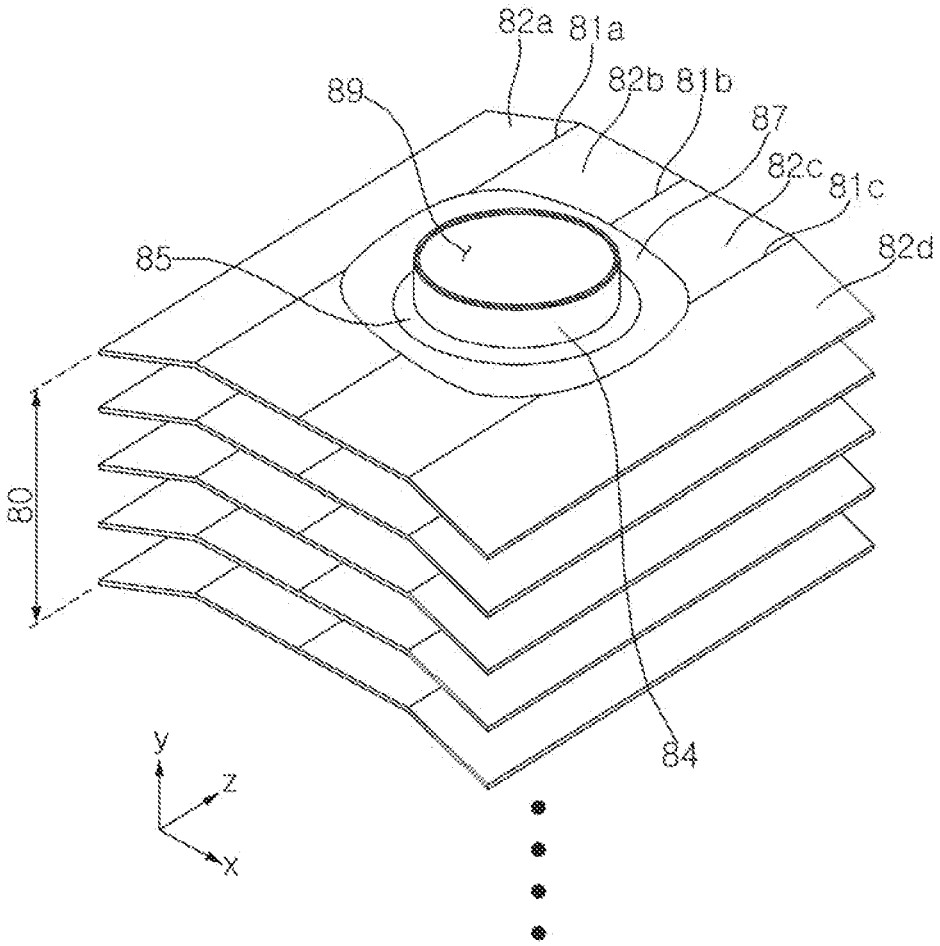
FIG. 7 illustrates a heat exchanger with fins of FIGS. 2 to 6 superimposed over one another.

FIG. 7 illustrates a heat exchanger with fins of FIGS. 2 to 6 superimposed over one another.

Referring to FIG. 7, a plurality of fins 80 having the sheet portion 85 and the corrugated portion are superimposed over one another, and the through-holes 89 are arranged to overlap each other.

As the heat transfer pipe 60 passes through the plurality of fins 80 to be coupled thereto, one heat exchanger 40 may be defined.

As described above, although the number of fins 80 is smaller than that of the related art, the sheet portion 85 of the oval shape elongated in a direction perpendicular to the air flow direction is increased in area, without a louver, thereby achieving the heat exchange efficiency.

Although embodiments have been described with reference to a number of illustrative embodiments thereof, it should be understood that numerous other modifications and embodiments can be devised by those skilled in the art that will fall within the scope of the principles of this disclosure. Therefore, the above detailed description should not be construed as restrictive in all respects and should be considered as illustrative.

The present invention encompasses various modifications to each of the examples and embodiments discussed herein. According to the invention, one or more features described above in one embodiment or example can be equally applied to another embodiment or example described above. The features of one or more embodiments or examples described above can be combined into each of the embodiments or examples described above. Any full or partial combination of one or more embodiment or examples of the invention is also part of the invention.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A heat exchanger comprising:

a heat transfer pipe configured to guide a refrigerant; and a plurality of fins spaced apart from each other to allow air to pass in a first direction, each the plurality of fins including:

a through-hole through which the heat transfer pipe is disposed;

a corrugated portion formed in a zigzag shape proceeding in the first direction; and a sheet portion recessed from the corrugated portion around the through-hole, the sheet portion being parallel with the first direction, wherein each of the plurality of fins includes a reference region, the reference region being defined by the through-hole, the corrugated portion and the sheet portion, wherein within each reference region, an area of the sheet portion corresponds to 16%-25% of an area of the reference region, wherein each sheet portion includes:

a first length in the first direction; and a second length in a second direction, the second direction being perpendicular to the first direction, wherein the second length is greater than the first length, wherein each of the plurality of fins further includes a connecting portion to connect the corrugated portion and the sheet portion, wherein each corrugated portion includes a plurality of inclined portions having an inclination with respect to the first direction, wherein the plurality of inclined portions of each corrugated portion includes two crest portions and a trough portion, wherein for each of the plurality of fins, the corrugated portion is formed in two inner inclined portions that are disposed between the two crest portions, wherein the trough portion is positioned between the two inner inclined portions, wherein the plurality of inclined portions of each corrugated portion includes outer inclined portions that define the two crest portions outside the two inner inclined portions, wherein for each of the plurality of fins, a length of each outer inclined portion that does not overlap with the connecting portion in the first direction is less than a length of each inner inclined portion, and wherein for each of the plurality of fins, the connecting portion is arranged to surround the sheet portion and separates the corrugated portion and the sheet portion.

2. The heat exchanger of claim 1, wherein for each of the plurality of fins, a ratio of the second length of the sheet portion to the first length of the sheet portion is in a range of 1.2 to 1.9.

3. The heat exchanger of claim 1, wherein for each of the plurality of fins, the sheet portion is configured such that a distance to the through-hole in the second direction is greater than a distance to the through-hole in the first direction.

4. The heat exchanger of claim 1, wherein each of the plurality of fins further includes a collar in surface contact with the heat transfer pipe, and wherein for each of the plurality of fins, the sheet portion is connected to an outer surface of the collar.

5. The heat exchanger of claim 4, wherein at least one of the corrugated portions of the plurality of fins is disposed between adjacent sheet portions among the plurality of fins.

6. The heat exchanger of claim 1, wherein for each of the plurality of fins, a center of the through-hole overlaps the trough portion in the second direction.

7. The heat exchanger of claim 1, wherein for each of the plurality of fins, a combined area of the two inner inclined portions corresponds to 70% or more of the area of the sheet portion.

8. The heat exchanger of claim 7, wherein for each of the plurality of fins, an overlapping length between each inner inclined portion and each crest portion is greater than or equal to 50% of the second length of the sheet portion in the second direction.

9. The heat exchanger of claim 7, wherein for each of the plurality of fins, the two crest portions do not overlap the sheet portion in the second direction.

10. The heat exchanger of claim 7, wherein for each of the plurality of fins, the two crest portions are positioned higher than the sheet portion in a third direction, and wherein the third direction is perpendicular to the first direction and to the second direction.

11. The heat exchanger of claim 1, wherein for each of the plurality of fins, a collar is formed through the sheet portion and protrudes upward and downward.

12. An air conditioner comprising:

an indoor heat exchanger configured to exchange heat with indoor air; and an outdoor heat exchanger configured to exchange heat with outdoor air, wherein at least one of the indoor heat exchanger and the outdoor heat exchanger comprises:

a heat transfer pipe to guide a refrigerant; and a plurality of fins spaced apart from each other to allow air to pass in a first direction, each of the plurality of fins including:

a through-hole through which the heat transfer pipe passes;

a corrugated portion formed in a zigzag shape proceeding in the first direction; and a sheet portion recessed from the corrugated portion around the through-hole, the sheet portion being parallel with the first direction, wherein each of the plurality of fins includes a reference region, the reference region being defined by the through-hole, the corrugated portion and the sheet portion, wherein within each reference region, an area of the sheet portion corresponds to 16%-25% of an area of the reference region, wherein each sheet portion includes:

a first length in the first direction; and a second length in a second direction, the second direction being perpendicular to the first direction, wherein the second length is greater than the first length, wherein each of the plurality of fins further includes a connecting portion to connect the corrugated portion and the sheet portion, wherein each corrugated portion includes a plurality of inclined portions having an inclination with respect to the first direction, wherein the plurality of inclined portions of each corrugated portion includes two crest portions and a trough portion, wherein for each of the plurality of fins, the corrugated portion is formed in two inner inclined portions that are disposed between the two crest portions, wherein the trough portion is positioned between the two inner inclined portions, wherein the plurality of inclined portions of each corrugated portion includes outer inclined portions that define the two crest portions outside the two inner inclined portions, wherein for each of the plurality of fins, a length of each outer inclined portion that does not overlap with the connecting portion in the first direction is less than a length of each inner inclined portion, and wherein for each of the plurality of fins, the connecting portion is arranged to surround the sheet portion and separates the corrugated portion and the sheet portion.

* * * * *